US010207901B2

(12) United States Patent
Salojarvi et al.

(10) Patent No.: US 10,207,901 B2
(45) Date of Patent: Feb. 19, 2019

(54) HANDRAIL SYSTEM OF A PEOPLE MOVER AND METHOD FOR PREVENTING INJURIES IN A HANDRAIL SYSTEM OF A PEOPLE MOVER

(71) Applicant: Kone Corporation, Helsinki (FI)

(72) Inventors: Jouni Salojarvi, Helsinki (FI); Visa Rauta, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 15/692,366

(22) Filed: Aug. 31, 2017

(65) Prior Publication Data

US 2018/0111800 A1 Apr. 26, 2018

(30) Foreign Application Priority Data

Oct. 21, 2016 (EP) ..... 16195059

(51) Int. Cl.
*B66B 21/02* (2006.01)
*B66B 29/04* (2006.01)
(Continued)

(52) U.S. Cl.
CPC ..... *B66B 29/04* (2013.01); *B66B 25/00* (2013.01); *B66B 21/02* (2013.01); *B66B 21/10* (2013.01)

(58) Field of Classification Search
CPC ..... B66B 29/02; B66B 29/04
(Continued)

(56) References Cited

U.S. PATENT DOCUMENTS 3,809,206 A * 5/1974 Bredehorn ..... B66B 29/04 198/323
3,835,977 A * 9/1974 Hewitt ..... B65H 29/66 198/323

(Continued)

FOREIGN PATENT DOCUMENTS

| | | | |
|---|---|---|---|
| EP | 1942074 | A1 | 7/2008 |
| JP | 2012/171714 | A | 9/2012 |
| JP | 2016/094278 | A | 5/2016 |

OTHER PUBLICATIONS

Extended European Search Report # 16195059 dated Feb. 21, 2017.

*Primary Examiner* — William R Harp
(74) *Attorney, Agent, or Firm* — Harness, Dickey & Pierce, P.L.C.

(57) ABSTRACT

The invention relates to a handrail system of a people mover, the handrail system comprising a circulating handrail and a safety system of a handrail inlet in a handrail housing. The safety system comprises a hatch provided around the handrail inlet in the handrail housing; and trigger means operationally connected between the hatch and the handrail housing to launch the hatch from a first position inwards into the handrail housing to a second position in response to a detection of an object touching the hatch or arriving to a safety area in front of the hatch. The handrail system further comprises a coupling for operatively connecting the circulating handrail and the safety system, the coupling being arranged to stop the handrail in response to the launch of the hatch inwards into the handrail housing or in response to a detection of an object by a sensor which the object is arriving to the safety area in front of the hatch. The invention further relates to method for preventing injuries in a handrail system of a people mover. The method comprises the steps of providing a hatch around a handrail inlet in a handrail housing of a circulating handrail; operationally connecting
(Continued)

the hatch, the handrail housing and the handrail; launching the hatch from a first position inwards into the handrail housing to a second position in response to a detection of an object touching the hatch or arriving to a safety area in front of the hatch; and stopping the handrail in response to the launch of the hatch inwards into the handrail housing or in response to a detection of an object by a sensor which the object is arriving to the safety area in front of the hatch.

18 Claims, 5 Drawing Sheets

(51) Int. Cl.
*B66B 25/00* (2006.01)
*B66B 21/10* (2006.01)

(58) Field of Classification Search
USPC ..... 198/323, 335–338
See application file for complete search history.

(56) References Cited

U.S. PATENT DOCUMENTS 4,619,355 A * 10/1986 Adrian ..... B66B 29/04 198/323
4,915,207 A * 4/1990 Henning ..... B66B 29/04 198/323
5,009,307 A * 4/1991 Chance ..... B65G 43/00 198/323
6,752,255 B2 * 6/2004 Lefeuvre ..... B66B 29/04 198/323
7,552,812 B2 * 6/2009 Gonzalez Alemany ..... B66B 29/04 198/323
7,552,813 B2 * 6/2009 Gonzalez Alemany ..... B66B 29/04 198/323
7,775,339 B2 * 8/2010 Ogimura ..... B66B 29/02 198/323
2003/0066732 A1 4/2003 Lefeuvre

* cited by examiner

HANDRAIL SYSTEM OF A PEOPLE MOVER AND METHOD FOR PREVENTING INJURIES IN A HANDRAIL SYSTEM OF A PEOPLE MOVER

This application claims priority to European Patent Application No. EP161950597 filed on Oct. 21, 2016, the entire contents of which are incorporated herein by reference.

FIELD OF THE INVENTION

The invention relates to a handrail system of a people mover.

The invention also relates to a method for preventing injuries in a handrail system of a people mover.

BACKGROUND OF THE INVENTION

People movers such as escalators, moving walkways or other moving passages comprise a synchronically moving circulating handrail on which passengers riding the people mover can hold until the handrail enters into a handrail housing for running through the handrail housing back to a starting point of the people mover.

The point in which the handrail enters into the handrail housing, i.e. the point where the handrail enters inside the people mover, is called a handrail inlet. The location of the handrail inlet is accessible for the passengers and as the people mover is equipped with an automatized movement the handrail inlet area needs special security focus for passenger safety and comfort as well as for product maintenance and repair.

Accidentally or with purpose the handrail inlet area can be reached for example with hand and fingers and when the people mover is in active mode it is necessary to provide automatic safety system that stops the handrail movement and prevents any damage for human tissue if the handrail inlet is reached.

To prevent injuries in the handrail inlet area JP 2012171714 discloses a detection piece that is arranged to protrude from the inlet face through which the handrail penetrates into the handrail housing. The detection piece comprises photoelectric sensors to detect an object and provide an alert when such object is detected.

One of the problems associated with the above detection piece is that it is an external device which does not recognize all cases where a passenger or people nearby is approaching the handrail inlet area. Also an external device is exposed to possible malicious damage.

BRIEF DESCRIPTION OF THE INVENTION

An object of the present invention is thus to provide a handrail system of a people mover so as to overcome the above problems. The objects of the invention are achieved by a handrail system and a method for preventing injuries in a handrail system of a people mover which are characterized by what is stated in the independent claims. The preferred embodiments of the invention are disclosed in the dependent claims.

The invention is based on the idea of providing an integral safety system in a handrail housing of a people mover. According to the invention a handrail system of a people mover comprises a circulating handrail and a safety system of a handrail inlet in a handrail housing. The safety system comprises a hatch provided around the handrail inlet in the handrail housing; and trigger means operationally connected between the hatch and the handrail housing to launch the hatch from a first position inwards into the handrail housing to a second position in response to a detection of an object touching the hatch or arriving to a safety area in front of the hatch. The safety area in front of the hatch is in close proximity of the hatch in the direction of the handrail. The object arriving to the safety area in front of the hatch. This means that an object is arriving close to the hatch in a predetermined area in which the object is detected. The approach of an object near the hatch area can be detected with a sensor which is for example a proximity sensor, a camera, time-of-flight sensor or other known means to detect a presence or arrival of an object in a detection range. The handrail system further comprising a coupling for operatively connecting the circulating handrail and the safety system, the coupling being arranged to stop the handrail in response to the launch of the hatch inwards into the handrail housing or in response to a detection of an object by a sensor which the object is arriving to the safety area in front of the hatch. The safety area in front of the hatch means a distance from the handrail inlet extending away from the handrail housing along the direction of the handrail which is preferably at maximum 15 cm, for example the safety area in front of the hatch is a range 0-15 cm from the handrail housing along the handrail, and further embodiment of the safety area is a range 0-10 cm from the handrail housing along the handrail. In the safety area the approach of an object can be detected which then causes the trigger means to operate and causing the handrail to stop.

So the hatch around the handrail inlet in the handrail housing reacts to a touch of an object or to the detection of an object arriving to the safety area as explained above. An example of a touch of an object is a physical push activity. When the hatch is touched or pushed with fingers or other human overhang the hatch launches immediately inwards into the handrail housing causing the handrail to stop. The hatch expands the handrail inlet so that the human overhang touching or pushing the hatch does not stick to the handrail inlet but can be freely removed from the handrail inlet. Also because of stopping the handrail movement the handrail does not carry the human overhang further inside the handrail housing.

In a preferred embodiment of the invention the hatch comprises two hatch parts that are arranged on both sides of the handrail inlet. The hatch parts are arranged to depart inside the handrail housing such that the direction vectors of the movement of the both hatch parts are angularly escaping manner compared to the handrail movement direction vector. In other words when the handrails movement direction is straight forward the first hatch part arranged on the left side of the handrail inlet is arranged to depart angularly left and the right hatch part arranged on the right side of the handrail inlet is arranged to depart angularly right. Both hatch parts react to a touch of an object on the area of either one of the hatch parts which means that it does not matter which one of the hatch parts recognize the touch activity both hatch parts will open simultaneously expanding the handrail inlet area.

In another embodiment of the invention the hatch comprises two hatch parts that are arranged on the upper side and the underside of the handrail inlet. The hatch parts are arranged to depart inside the handrail housing such that the direction vectors of the movement of the both hatch parts are angularly escaping manner compared to the handrail movement direction vector. In other words when the handrails movement direction is straight forward the first hatch part arranged on the upper side of the handrail inlet is arranged to depart angularly up and the second hatch part is arranged on the underside of the handrail inlet is arranged to depart angularly down. Both hatch parts react to a touch of an object on the area of either one of the hatch parts which means that it does not matter which one of the hatch parts recognize the touch activity both hatch parts will open simultaneously expanding the handrail inlet area.

According to the invention the method for preventing injuries in a handrail system of a people mover comprises the steps of providing a hatch around a handrail inlet in a handrail housing of a circulating handrail; operationally connecting the hatch, the handrail housing and the handrail; launching the hatch from a first position inwards into the handrail housing to a second position in response to a detection of an object touching the hatch or arriving to a safety area in front of the hatch; and stopping the handrail in response to the launch of the hatch inwards into the handrail housing or in response to a detection of an object by a sensor which the object is arriving to the safety area in front of the hatch.

As described above the hatch is launched in response to a touch of an object when sensing an object's arrival or presence in the safety area in front of the handrail inlet in the hatch. The touch of an object and/or sensing its arrival in the safety area is a way to detect hazardous situation and it can vary from a minor touch or even an approach of an object near enough to the hatch to a push force or pushing activity. An approach of an object can be detected for example with a proximity sensor, a camera, time-of-flight sensor or other known means to detect a presence or arrival of an object in a detection range. Throughout the description when the hatch is said to be launched in response to a touch of an object also sense of an object's arrival or presence in the safety area of the handrail inlet is meant.

In the method according to the invention a preferred embodiment comprises a step of launching the hatch from the first position to the second position in a speed that is faster than the speed of the handrail.

An advantage of the handrail system and the method of the invention is that the safety of passengers and people nearby the handrail inlet is improved because pinching of body parts between the handrail and handrail inlet is prevented by providing an expanded opening in the handrail inlet area. The safety system is reliable because the hatch around the handrail inlet reacts on a touch activity and immediately launches inside the handrail housing stopping the handrail movement. The parts of the handrail system are enduring because there are no external devices protruding from the handrail housing.

BRIEF DESCRIPTION OF THE DRAWINGS

In the following the invention will be described in greater detail by means of preferred embodiments with reference to the attached drawings, in which.

DETAILED DESCRIPTION OF THE INVENTION

Figure 1A:
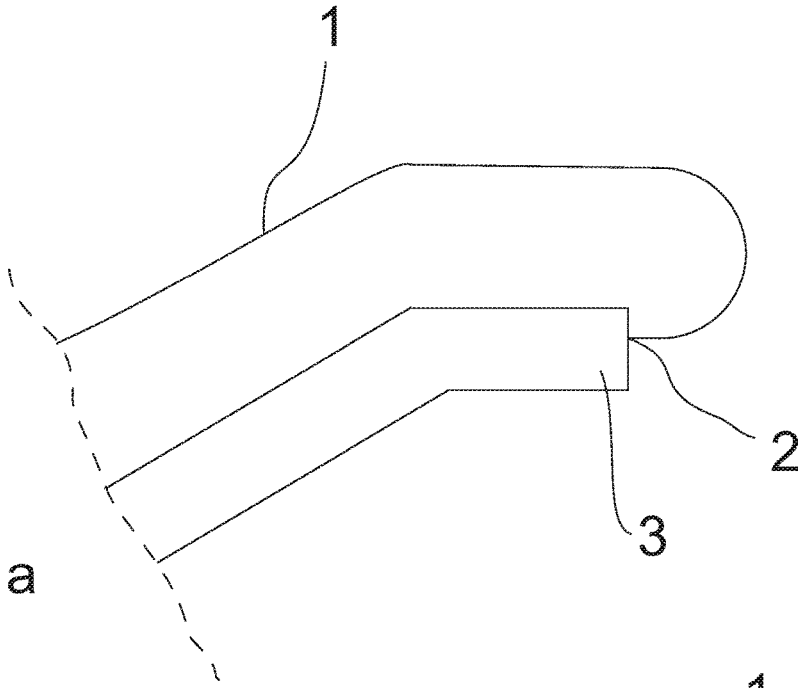
FIG. 1*a* shows an overview of a people mover.
Figure 1B:
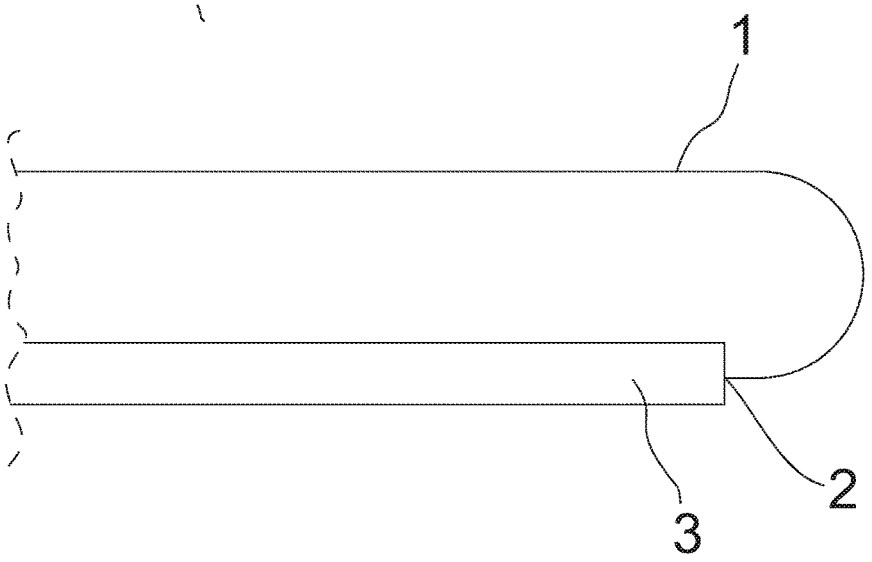
FIG. 1*b* shows an overview of another people mover.

FIG. 1*a* shows an overview of a people mover which is an escalator and FIG. 1*b* shows an overview of a people mover which is a moving walkway. The invention relates to people movers which as seen in FIGS. 1*a* and 1*b* can be an escalator or a moving walkway or another suitable people mover. The handrail 1 of the people mover is arranged to circulate in the handrail system such that part of the handrail 1 is exposed to passengers for them to keep hand on it while being moved by the people mover and part of the handrail 1 is provided inside a handrail housing 3, the handrail 1 circulates such that it is turned back towards the moving direction in the ends of the people mover. The point in which the circulating handrail 1 moves inside the handrail housing 3 is a handrail inlet 2. The handrail inlet 2 in other words changes the path of the handrail 1 from external to internal. FIGS. 1*a* and 1*b* show only one end of the people mover while the other end of the people mover is similar to the shown one. For the security of the passengers and people nearby the handrail inlet 2 has to have a safety system in order to prevent injuries.

Figure 2A:
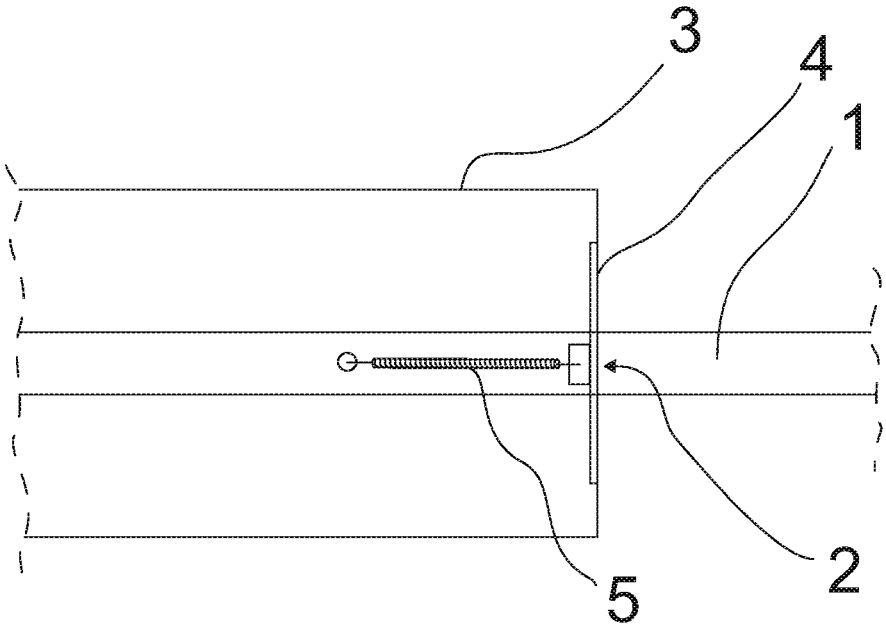
FIG. 2*a* shows a first embodiment of the invention in a first position.

FIG. 2*a* shows the first embodiment of the handrail system according to the invention in which the handrail system comprises a circulating handrail 1 and a safety system of a handrail inlet 2 in a handrail housing 3. The safety system comprises a hatch 4 provided around the handrail inlet 2 in the handrail housing 3 and trigger means 5 operationally connected between the hatch 4 and the handrail housing 3 to launch the hatch 4 from a first position inwards into the handrail housing 3 to a second position in response to a touch of an object on the hatch 4. The FIG. 2 a shows the first position of the hatch 4 in which the hatch 4 is arranged around the handrail inlet 2 in a closed position so that it covers the surround area of the handrail inlet 2. The trigger means 5 which in this embodiment of the invention is a spring is prestressed between the hatch 4 and the handrail housing 3 so that the other end of the spring is connected to the housing and the other end of the spring is connected to the hatch 4 or its supporting structure. When the hatch 4 is touched for example so that push force is executed on it the hatch 4 is arranged to launch inwards to the second position into the handrail housing 3 and cause the handrail 2 to stop in response to a touch of an object in the area of the hatch 4. The launch movement direction in this embodiment of the invention is the same as the handrail's 1 movement direction because the hatch 4 is provided around the handrail inlet 2 so that the handrail 1 must fit all the time in a handrail opening in the hatch 4. In other words the hatch 4 comprises an opening preferably in the centre part of the hatch 4 for providing a passage for the handrail 1.

Figure 2B:
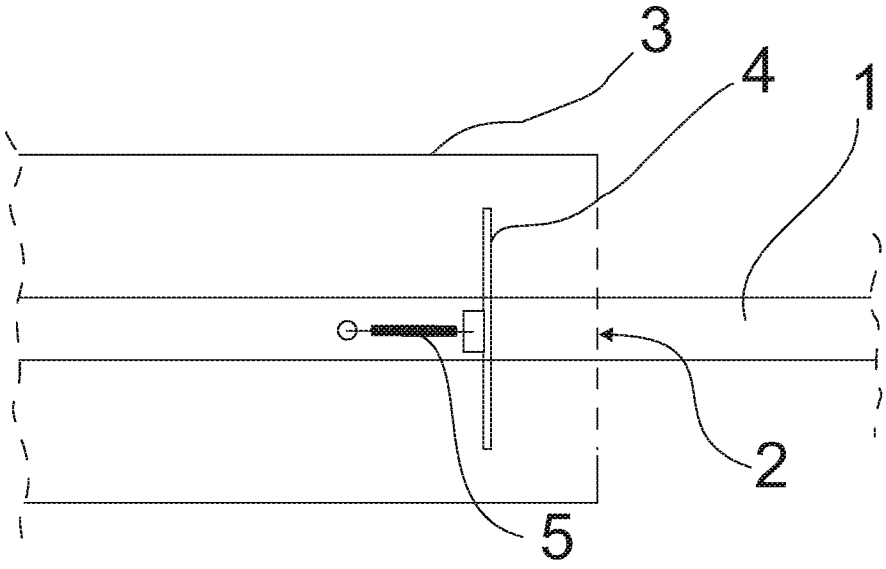
FIG. 2*b* shows the first embodiment of the invention in a second position.

FIG. 2*b* shows the first embodiment of the handrail system according to the invention in which the hatch 4 is launched into the handrail housing 3 to the second position. This means that the safety system has been activated by a touch of an object on the hatch 4 and the hatch 4 is launched into the handrail housing 3 to the second position. The handrail system further comprises a coupling for operatively connecting the circulating handrail 1 and the safety system. The coupling is arranged to stop the handrail 1 in response to the launch of the hatch 4 inwards into the handrail housing 3. So in the FIG. 2*a* the handrail 1 is moving and in the FIG.

2*b* as the safety system has been activated and the hatch 4 has been launched the handrail 1 has stopped moving.

Figure 3:
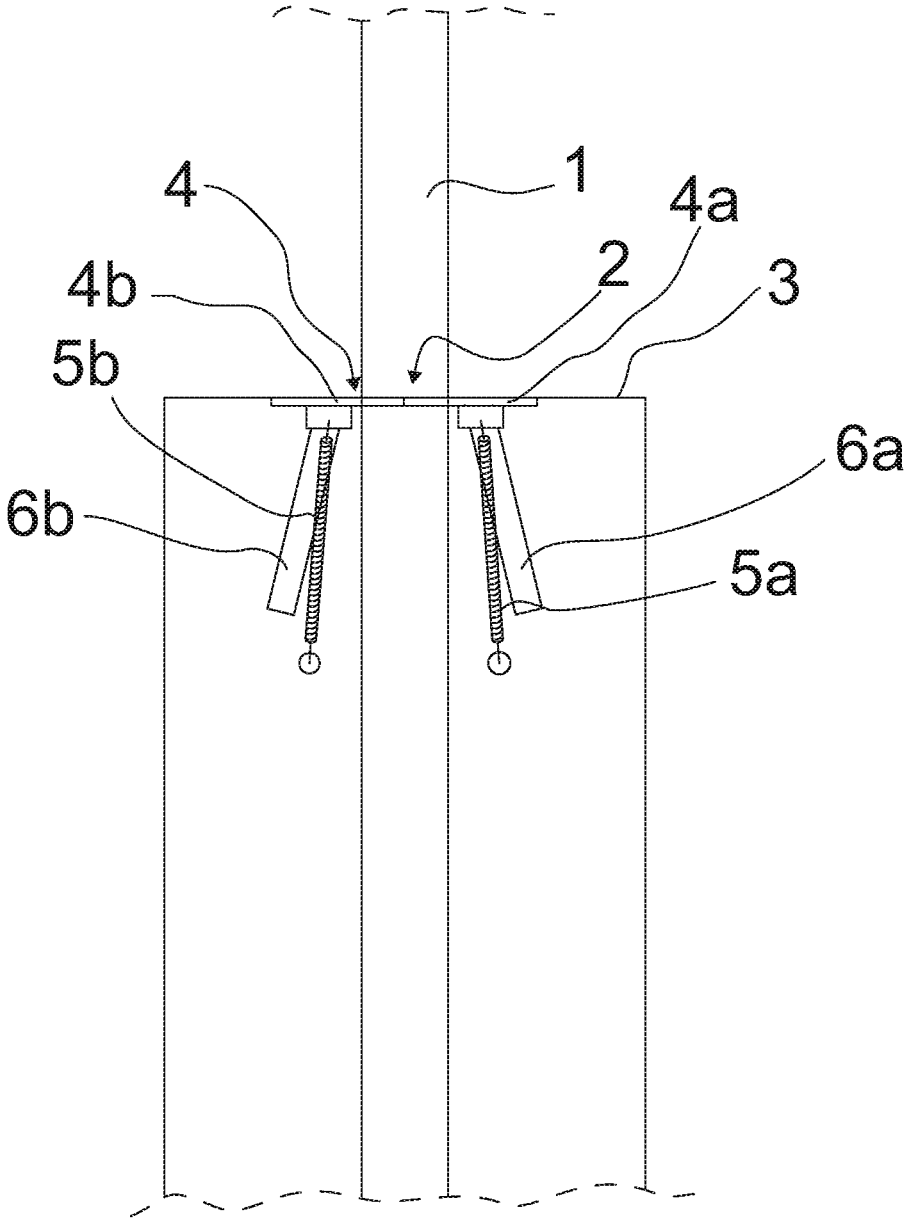
FIG. 3 shows a second embodiment of the invention from top.

FIG. 3 shows the second embodiment of the invention in which the hatch 4 comprises a first hatch part 4*a* and a second hatch part 4*b* which said first and second hatch parts 4*a*, 4*b* are arranged to be launched together simultaneously inwards into the handrail housing 3 for providing an opening around the handrail inlet 2. The trigger means 5 comprise prestressing means for prestressing the connection between the hatch 4 and the handrail housing 3 and in this embodiment of the invention there are two trigger means 5*a*, 5*b* so that the first trigger means 5*a* is connected between the first hatch part 4*a* and the handrail housing 3 and the second trigger means 5*b* is connected between the second hatch part 4*b* and the handrail housing 3. The trigger means 5*a*, 5*b* comprise in this embodiment of the invention prestressing means for prestressing the connection between the hatch 4 and the handrail housing 3 and in particular in this embodiment springs prestressed between the hatch parts 4*a*, 4*b* and the handrail housing 3. In other words the prestressing means connected between the hatch 4 and the handrail housing 3 is a spring such that a first spring 5*a* is arranged between the first hatch part 4*a* and the handrail housing 3 and a second spring 5*b* is arranged between the second hatch part 4*b* and the handrail housing 3.

Figure 4A:
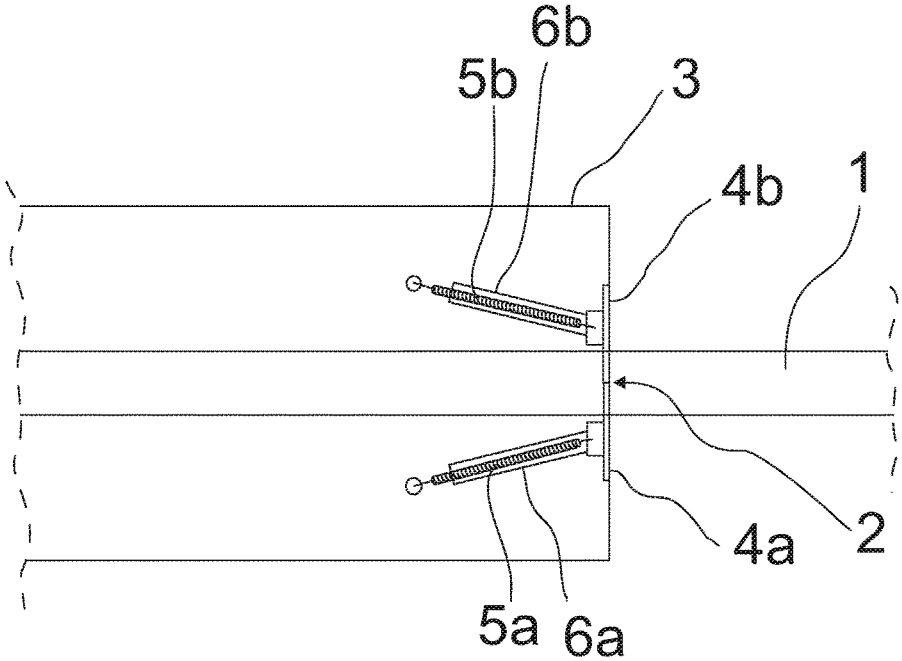
FIG. 4*a* shows the second embodiment of the invention in a first position.
Figure 4B:
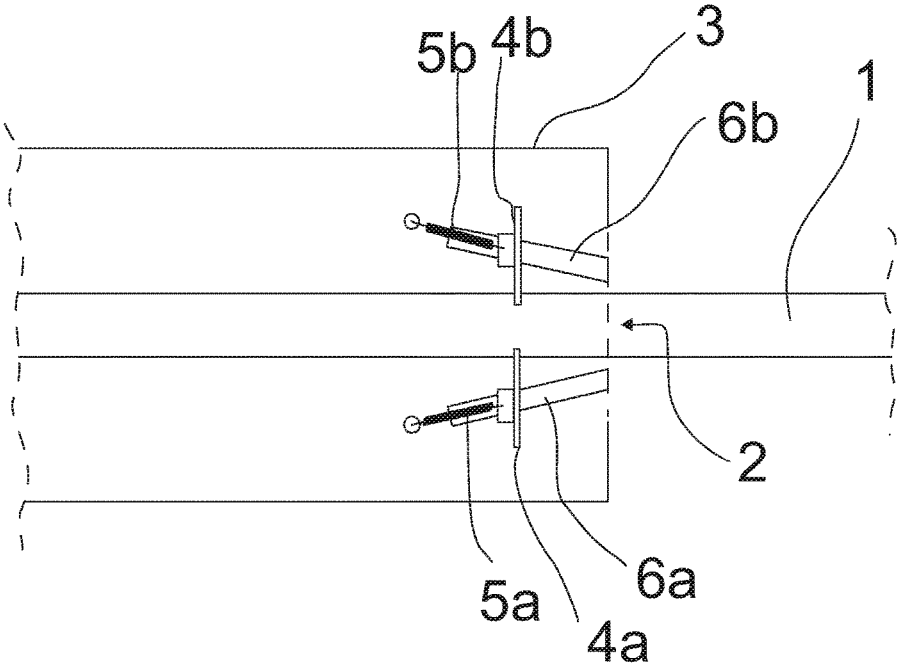
FIG. 4*b* shows the second embodiment of the invention in a second position.

FIGS. 4*a* and 4*b* show the second embodiment of the invention in which the hatch parts 4*a*, 4*b* are launched from the first position to the second position. In FIG. 4*a* the two hatch parts, i.e. the first hatch part 4*a* and the second hatch part 4*b* are in the first position around the handrail inlet 2 closing the surround area of the handrail inlet 2. When an object has touched on either one of the hatch parts 4*a*, 4*b* both hatch parts 4*a*, 4*b* are arranged to launch inwards from the first position to the second position so that the first and the second hatch parts 4*a* and 4*b* are operated together for providing an expanded opening around the handrail inlet 2. The first and second hatch parts 4*a*, 4*b* are arranged to move into the handrail housing 3 angularly relative to the moving direction of the handrail 1. The first hatch part 4*a* is arranged to move along a first track 6*a* and the second hatch part 4*b* is arranged to move along a second track 6*b* inside the handrail housing 3. I.e. the hatch 4 is arranged to move along a track 6 inside the handrail housing 3 such that the first hatch part 4*a* is arranged to move along a first track 6*a* and the second hatch part 4*b* is arranged to move along a second track 6*b* when launched from the first position inwards into the handrail housing 3 to the second position. The hatch 4 or both the hatch parts 4*a*, 4*b* immediately launch inwards to the handrail housing 3 when an object has touched on the hatch 4 or either one of the hatch parts 4*a*, 4*b*. The speed of inward launch movement is faster than the speed of the handrail 1 and the direction vectors of the movement of both hatch parts 4*a*, 4*b* are angularly escaping in manner compared to the handrail 1 movement direction vector. The left (when viewed on the outer surface of the handrail housing 1 on the side where the handrail inlet 2 is provided) hatch 4*a* departs angularly left inside the handrail housing 3, the right hatch 4*b* departs angularly right inside the handrail housing 3. This movement directions of the hatch parts 4*a*, 4*b* eliminate human overhangs from jamming and damaging because of the expanding handrail inlet 2 opening. The hatch parts 4*a*, 4*b* inward movement length is maximized so that there is enough space provided inside the handrail housing 3 for withdrawing the human overhang from the opening. As already mentioned the touch of an object needed to launch the safety system is equal on all reactive area which means that the touch of an object on either one of the hatch parts 4*a*, 4*b* or anywhere in the hatch 4 launches them inward into the handrail housing 3 and causes the handrail 1 to stop. These aspects eliminate effectively the danger of tissue damage of the potential victim. To reclose the hatch parts 4*a*, 4*b*, they are pulled by hand separately or simultaneously from specific pull parts back to the start position, i.e. from the second position to the first position, enabling the safety system and the handrail system to work normally again. In FIGS. 4*a* and 4*b* the hatch parts 4*a*, 4*b* are equipped with pull force springs, which are loaded onto a start position when the handrail system operates normally again, i.e. the springs are loaded onto the first position. The touch of an object to the hatch 4 or either one of the hatch parts 4*a*, 4*b* causes the spring load to release, causing the hatch 4 or the hatch parts 4*a*, 4*b* to launch inwards. Strength of the springs loaded force enables the hatch parts 4*a*, 4*b* to escape inwards faster than the handrail 1. The hatch parts 4*a*, 4*b* escape movement is stopped preferably with stop cushions.

Figure 5:
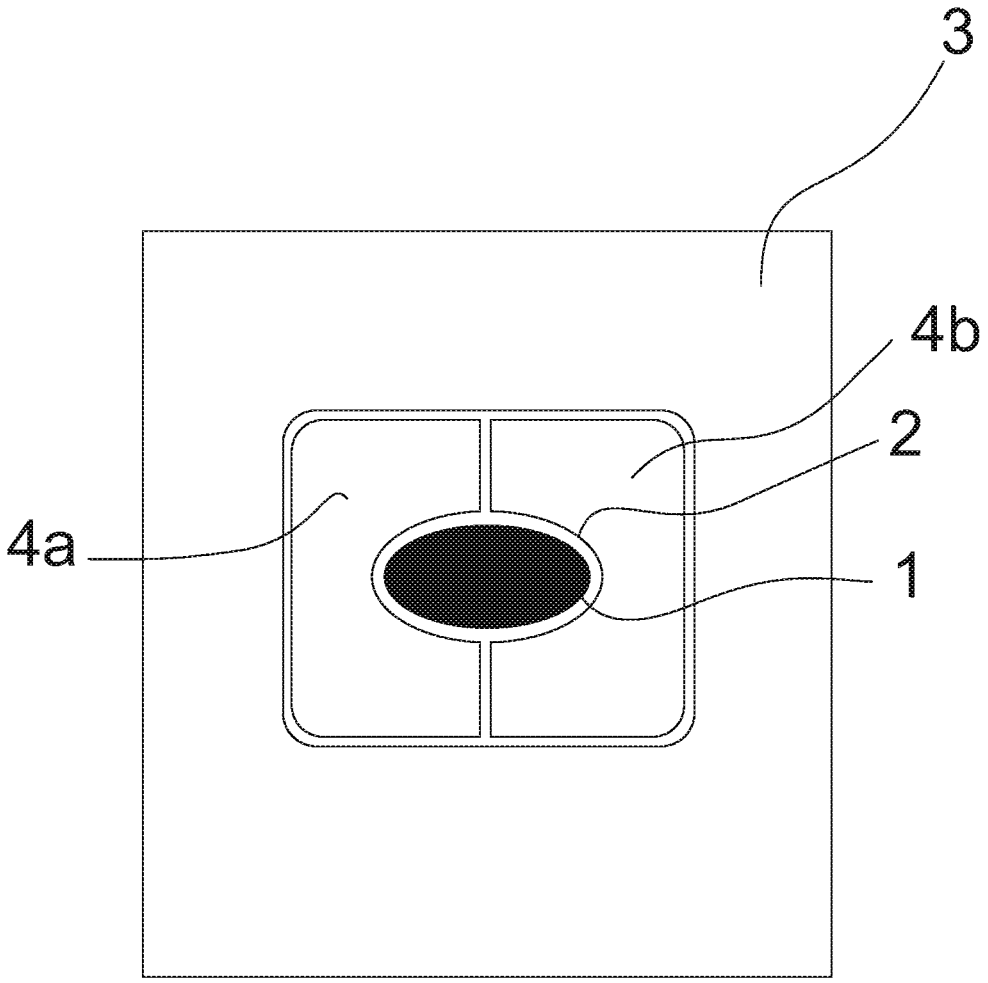
FIG. 5 shows the second embodiment of the invention from outside.

FIG. 5 shows the second embodiment of the invention from outside. The handrail housing 3 comprises the handrail inlet 2 such that the handrail 1 can move into the handrail housing 3. The hatch parts 4*a*, 4*b* are arranged on both sides of the handrail inlet 2 covering the surrounding area of the handrail inlet 2.

Although all the figures show springs being the prestressing means in other embodiments of the invention the prestressing means connected between the hatch 4 and the handrail housing 3 or between the hatch parts 4*a*, 4*b* and the handrail housing 3 can be an elastic rubber member or elastic rubber members. Also the trigger means may comprise a magnetic connection or an electrical connection between the hatch 4 and the handrail housing 3 for launching the hatch 4 from the first position to the second position.

According to the method for preventing injuries in a handrail system of a people mover of the invention the method comprises the steps of providing a hatch 4 around a handrail inlet 2 in a handrail housing 3 of a circulating handrail 1; operationally connecting the hatch 4, the handrail housing 3 and the handrail 1; launching the hatch 4 from a first position inwards into the handrail housing 3 to a second position in response to a touch of an object on the hatch 4; and stopping the handrail 1 in response to the launch of the hatch 4 inwards into the handrail housing 3. The hatch 4 comprises a first hatch part 4*a* and a second hatch part 4*b* provided around the handrail inlet 2 and the method further comprises the step of launching the first hatch part 4*a* and the second hatch part 4*b* simultaneously from the first position inwards into the handrail housing 3 to the second position in response to a touch of an object on either one of the hatch parts 4*a*, 4*b*. The method further comprises the step of moving the first hatch part 4*a* and the second hatch part 4*b* angularly escaping manner compared to the movement of the handrail 1. The method further comprises the step of arranging the speed of the launch movement of the hatch 4 to be faster than the speed of the handrail 1.

It will be obvious to a person skilled in the art that, as the technology advances, the inventive concept can be implemented in various ways. The invention and its embodiments are not limited to the examples described above but may vary within the scope of the claims.

The invention claimed is:

1. A handrail system of a people mover, the handrail system comprising:

a circulating handrail; and a safety system of a handrail inlet in a handrail housing, the safety system including, a hatch associated with the handrail inlet in the handrail housing; and a triggering device operationally connected between the hatch and the handrail housing, the triggering device including one of (i) an elastic connection (ii) a magnetic connection and (iii) an electrical connection between the hatch and the handrail housing to launch the hatch from a first position inwards into the handrail housing to a second position in response to an object touching the hatch or arriving to a safety area in front of the hatch; and a coupling operatively connecting the circulating handrail and the safety system, the coupling configured to stop the handrail in response to one or more of (i) the launch of the hatch inwards into the handrail housing and (ii) a detection, by a sensor, of an object arriving to the safety area in front of the hatch.

2. The handrail system according to claim 1, wherein the hatch comprises:

a first hatch part and a second hatch part configured to launch together simultaneously inwards into the handrail housing to form an opening around the handrail inlet.

3. The handrail system according to claim 2, wherein the triggering device is a pair of springs including, a first spring between the first hatch part and the handrail housing, and a second spring between the second hatch part and the handrail housing.

4. The handrail system according to claim 1, wherein the elastic connection between the hatch and the handrail housing is one of a spring and an elastic rubber member.

5. The handrail system according to claim 1, wherein the hatch comprises:

a first hatch part configured to move into the handrail housing angularly relative to the handrail; and a second hatch part configured to move into the handrail housing angularly relative to the handrail.

6. The handrail system according to claim 5, wherein the first hatch part is configured to move along a first track when launched from the first position inwards into the handrail housing to the second position, and the second hatch part is configured to move along a second track when launched from the first position inwards into the handrail housing to the second position.

7. The handrail system according to claim 1, wherein the hatch is configured to move along a track inside the handrail housing.

8. The handrail system according to claim 1, wherein the sensor is includes one or more of a proximity sensor, a camera, and a time-of-flight sensor, the sensor configured to detect an approach of an object near the hatch safety area.

9. A method of operating a handrail system of a people mover, the handrail system including a safety system of a handrail inlet in a handrail housing of a circulating handrail, the handrail inlet including a hatch associated therewith in the handrail housing, and a triggering device operationally connected between the hatch and the handrail housing, the triggering device including one of (i) an elastic connection (ii) a magnetic connection and (iii) an electrical connection between the hatch and the handrail housing, the method comprising:

launching, via the triggering device, the hatch from a first position inwards into the handrail housing to a second position in response to an object touching the hatch or arriving to a safety area in front of the hatch; and stopping the handrail in response to one or more of (i) the launch of the hatch inwards into the handrail housing and (ii) a detection, by a sensor, of an object arriving to the safety area in front of the hatch.

10. The method according to claim 9, wherein the hatch includes a first hatch part and a second hatch part provided around the handrail inlet and the method further comprises:

launching the first hatch part and the second hatch part simultaneously from the first position inwards into the handrail housing to the second position in response to the object touching the hatch or arriving to the safety area in front of one of the first hatch part and the second hatch part.

11. The method according to claim 10, further comprising:

moving the first hatch part and the second hatch part angularly compared to movement of the handrail.

12. The method according to any of claim 9, wherein the method further comprises:

arranging a speed of the launching of the hatch to be faster than a speed of the handrail.

13. A safety system of a handrail inlet in a handrail housing of a people mover, the safety system comprising:

a hatch associated with the handrail inlet in the handrail housing; and a triggering device operationally connected between the hatch and the handrail housing, the triggering device including one of (i) an elastic connection (ii) a magnetic connection and (iii) an electrical connection between the hatch and the handrail housing, the triggering device configured to launch the hatch from a first position inwards into the handrail housing to a second position to stop the handrail, in response to an object touching the hatch or arriving to a safety area in front of the hatch.

14. The safety system according to claim 13, wherein the elastic connection between the hatch and the handrail housing is one of a spring and an elastic rubber member.

15. The safety system according to claim 13, wherein the hatch is configured to move along a track inside the handrail housing.

16. The safety system according to claim 13, wherein the hatch comprises:

a first hatch part and a second hatch part configured to launch together simultaneously inwards into the handrail housing to form an opening around the handrail inlet.

17. The safety system according to claim 16, wherein the triggering device is a pair of springs including, a first spring between the first hatch part and the handrail housing, and a second spring between the second hatch part and the handrail housing.

18. The safety system according to claim 16, wherein the first hatch part is configured to move along a first track when launched from the first position inwards into the handrail housing to the second position, and the second hatch part is configured to move along a second track when launched from the first position inwards into the handrail housing to the second position.

* * * * *